United States Patent [19]

Kurahasi et al.

[11] 4,074,632

[45] Feb. 21, 1978

[54] SWITCH FOR MONORAIL TRACK WITH ROTARY DRIVE SHAFT

[75] Inventors: Yutaka Kurahasi; Nobuyuki Ihara, both of Tokyo, Japan

[73] Assignee: SI Handling Systems, Inc., Easton, Pa.

[21] Appl. No.: 639,938

[22] Filed: Dec. 11, 1975

[30] Foreign Application Priority Data

Dec. 13, 1974 Japan ..... 49-150420[U]

[51] Int. Cl.[2] ..... B61B 13/12; E01B 25/12

[52] U.S. Cl. ..... 104/130; 104/121; 104/166

[58] Field of Search ..... 104/130, 166, 172 S, 104/172 B, 88, 89, 92, 93, 96, 100, 103, 104, 119, 121, 242, 243, 245, 247

[56] References Cited

U.S. PATENT DOCUMENTS

| | | | |
|---|---|---|---|
| 423,872 | 3/1890 | Judson | 104/166 |
| 3,118,393 | 1/1964 | Ohlin | 104/166 |
| 3,356,040 | 12/1967 | Fonden | 104/166 |
| 3,537,402 | 11/1970 | Harkess | 104/89 |
| 3,712,241 | 1/1973 | Kuwertz | 104/103 |
| 3,777,669 | 12/1973 | Lott et al. | 104/119 |
| 3,817,184 | 6/1974 | Stafford et al. | 104/121 |
| 3,845,723 | 11/1974 | Jacobs, Jr. et al. | 104/121 |
| 3,861,322 | 1/1975 | Danly | 104/166 |
| 3,897,734 | 8/1975 | Watts | 104/130 |
| 3,903,810 | 9/1975 | Jones | 104/166 |

*Primary Examiner*—Lawrence J. Oresky
*Assistant Examiner*—Carl Rowold
*Attorney, Agent, or Firm*—Seidel, Gonda & Goldhammer

[57] ABSTRACT

The article delivery device of the present invention is in the form of a conveyor system having a main branch with one or more auxiliary branches coupled thereto for use in connection with vehicles which are driven by frictional contact between a rotating drive shaft and a drive wheel coupled to the vehicle.

14 Claims, 7 Drawing Figures

FIG. 1
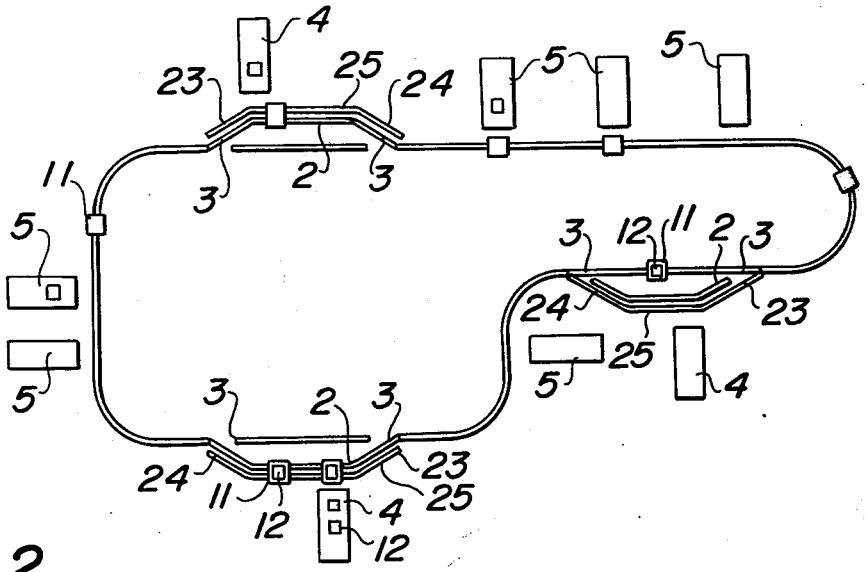
FIG. 2
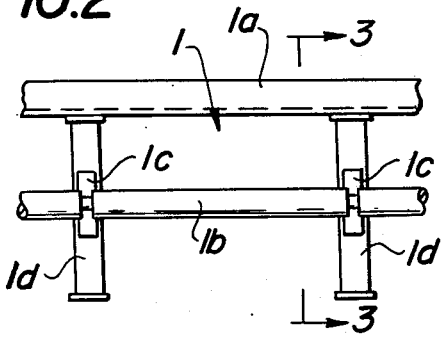
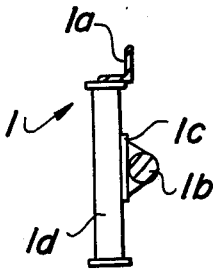
FIG. 3
FIG. 4
FIG. 6
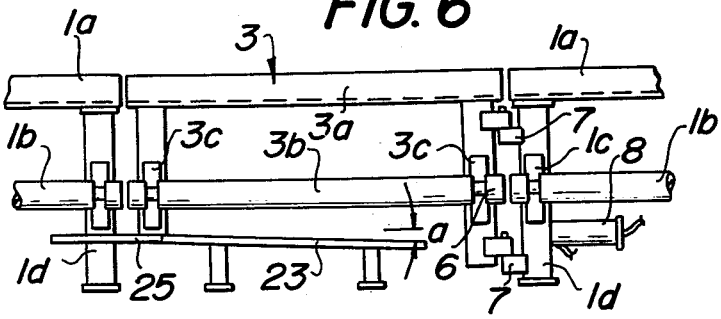
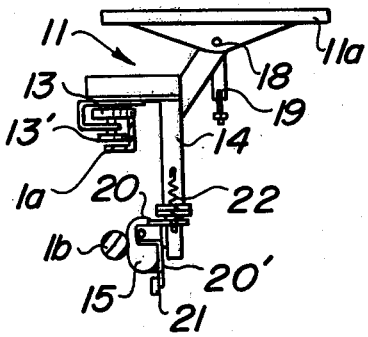
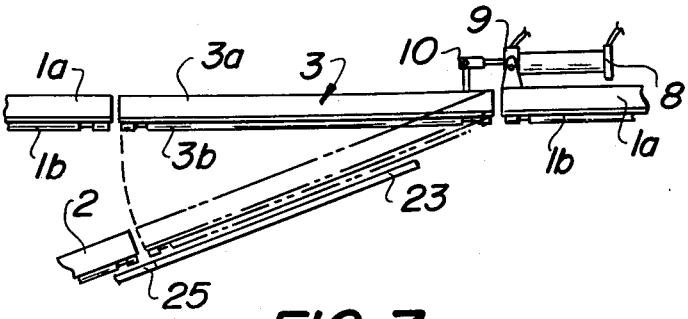
FIG. 7
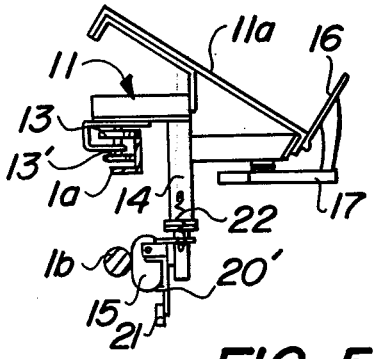
FIG. 5

SWITCH FOR MONORAIL TRACK WITH ROTARY DRIVE SHAFT

BACKGROUND

The subject matter of the present invention relates to a vehicle and/or system of the type disclosed in U.S. Pat. Nos. 3,903,810; 3,118,393; and 3,356,040.

The present invention is an improvement on the type of vehicle and the type of control system for controlling the path of movement and speed of the vehicle.

This invention is directed to article delivery apparatus comprising a main conveyor line and an auxiliary conveyor line. A junction is provided between said lines. Each of said conveyor lines has a track and a horizontally disposed drive shaft. Each of the shafts are rotatable about their longitudinal axes.

A vehicle is provided to support and deliver an article. The vehicle is mounted for movement along said lines. The vehicle has a wheel for rolling contact with the tracks and a drive wheel for frictional contact with the shafts. A means is provided to bias the drive wheels so that its axis of rotation is angled with respect to the longitudinal axis of one of said shafts.

A transfer means is provided at the junction between said lines for transferring the vehicle between said lines in a manner so that said drive wheel is transferred from driving contact with one shaft to driving contact with the other shaft. A means is provided on or adjacent transfer means for changing the speed of movement of the vehicle.

On the main conveyor line, the vehicles move at a high speed. On the auxiliary conveyor line, the vehicles move at a slow speed or physically stop to facilitate loading or unloading of articles from the vehicle.

For the purpose of illustrating the invention, there is shown in the drawings a form which is presently preferred; it being understood, however, that this invention is not limited to the precise arrangements and instrumentalities shown.

FIG. 1 is a plan view showing diagrammatically the entire outline of the apparatus.

FIG. 2 is an enlarged elevation view of the main conveyor line.

FIG. 3 is a sectional view taken along the line 3—3 in FIG. 2.

FIGS. 4 and 5 are sectional views through the main conveyor line illustrating alternative embodiments of vehicles.

FIG. 6 is a side elevation view of the transfer means at a junction between the main conveyor line and the auxiliary conveyor line.

FIG. 7 is a top plan view of the junction shown in FIG. 6.

Referring to the drawing in detail, wherein like numerals indicate like elements, there is shown in preferred embodiment of the present invention. The main conveyor line is designated 1. The auxiliary conveyor line is designated 2. A transfer means for transferring a vehicle between said conveyor lines is designated 3. The main conveyor line 1 facilitates sorting of articles. The main conveyor line has a plurality of unloading chutes 5 disposed therealong in the mid-portion thereof. A switch-type branching or transfer device 3 interconnects the main conveyor line 1 with the auxiliary conveyor line 2. The auxiliary conveyor line 2 has a plurality of transfer machines 4 which are operatively associated with the entire apparatus.

As shown more clearly in FIG. 2, the main conveyor line 1 comprises a rail 1*a* disposed to one side of a horizontally disposed drive shaft 1*b*. The drive shaft 1*b* is provided with bearings 1*c* at spaced points therealong. The bearings are supported by a stanchion 1*d* or the like. The drive shaft 1*b* rotates about its longitudinal axis.

Carts 11 are adapted to be conveyed along the main and auxiliary lines for delivery and sorting of articles 12. Referring to FIG. 4, the cart 11 applies a force to the drive wheel 15 which is in contact with the drive shaft 1*b* as a result of the eccentric moment created by the weight of the cart 11 and any articles 12 supported thereby. It will be noted that the surface of drive shaft 1*b* contacted by the drive wheel 15 lies in a vertical plane disposed between the rail 1*a* and an imaginary vertical plane containing the center of gravity of the vehicle 11. When the friction between drive wheel 15 and drive shaft 1*b* is at a certain angle, and with the drive shaft 1*b* rotating, an affect is attained in the same manner as a screw effect with the result that the cart 11 is moved forward or backward.

The vehicle 11 includes a platform or support 11*a* for supporting the articles 12. The platform 11*a* is above a frame 14 which supports a driven wheel 13. The driven wheel 13 rotates at its periphery on the track 1*a*. A secondary wheel 13′ is in rolling contact with the left vertical surface of the track 1*a* so as to prevent the vehicle 11 from rotating off the track by rotation in a clockwise direction in FIG. 4.

The platform 11*a* may be provided with a pin 18 to facilitate rotation of the platform with respect to the frame 14. Rotation of the platform 11*a* is controlled by rod 19.

The drive wheel 15 is supported by a bracket 20. Bracket 20 is rotatably supported by the frame 14 in response to movement of shaft 20′. Shaft 20′ supports a sensor roller 21 at its lower end. Roller 21 is adapted when contacting an object to rotate bracket 20 to thereby change the angle between the axis of rotation of drive wheel 15 and the longitudinal axis of shaft 1*b*. Spring 22 extends between the frame 14 and the bracket 20 and tends to bias the drive wheel 15 to a drive position.

In FIG. 5, there is illustrated another embodiment of the vehicle wherein the platform 11*a* is inclined. At the lower end of the inclined platform, there is provided a discharge gate 16 which is adapted to be tripped by a device 17 as the vehicle moves along the track. The location of the device 17 determines where the gate 16 will be tripped and the load discharged off platform 11*a*.

FIG. 6 illustrates the transfer device 3 which facilitates transferring the vehicle from movement along the main conveyor line 1 to movement along an auxiliary conveyor line 2. Each auxiliary conveyor line 2 has a portion parallel to the main conveyor line and at least one, preferably both ends communicating therewith by way of a separate transfer device 3. See FIG. 1.

The transfer device 3 includes a frame 3*a* wherein the top member thereof forms a continuation of the rail 1*a* and performs the function of such rail. The transfer device 3 also includes a drive shaft 3*b* supported by bearings 3*c*. The drive shaft 3*b* is adapted to form a continuation of the main drive shaft 1*b* when aligned therewith as shown in solid lines in FIG. 7.

The transfer device 3 is adapted to pivot from the solid line position in FIG. 7 to the phantom position in FIG. 7 wherein the lefthand end of the device 3 aligns with the auxiliary line 2. Thus, the device 3 is pivotable about the hinge 7 and is provided with a driving shaft torque transmission ball joint 6 so that the drive shaft 3*b* rotates about its longitudinal axis in all positions of the transfer device 3. A cylinder 8 is supported by the main conveyor line 1 and is connected to a portion of the transfer device 3 by way of the connecting structure 10. Cylinder 8 pivots about pin 9. The auxiliary line 2 comprises not only the same rail and drive shafts as described above in connection with the main conveyor line 1 but also includes a speed control device 25 adapted to cooperate with sensor roller 21 mounted on the bracket 20. The device 25 has a speed reducing portion 23 which is in the form of an upward gradient at an angle $\alpha$ on its inlet side. As shown in FIG. 1, the outlet side of the auxiliary conveyor 2 has a reverse gradient speed in increasing portion 24. Thus, the vehicle will change its speed as it enters or departs from the auxiliary line 2.

A curved portion of the main or auxiliary lines is attained by making that portion of the drive shaft from a flexible material and providing an appropriate corresponding curve on the associated rail. The vehicle is always on the outside of the main conveyor line 1 for transfer to the auxiliary conveyor lines which likewise are outside the loop of the main conveyor line. The reverse would be true if the auxiliary lines were inside the loop of the main conveyor line.

In the apparatus described above, a plurality of carts 11 are placed on the rail 1*a* of the main conveyor line 1. Due to the relationship between the drive shaft 1*b* and the drive wheel 15 on the respective vehicles, the vehicles move along the main conveyor line 1 at high speed depending upon the speed of rotation of the main drive shaft. When the cylinder 8 is activated, the device 3 moves from the solid line to phantom position as shown in FIG. 7 whereby a vehicle moving therealong will transfer onto the auxiliary conveyor 2. The vehicle automatically slows down as sensor roller 21 contacts the inclined speed reducing portion 23. This causes the roller 21 to be pushed upwardly and the bracket 20 rotated against the force of spring 22 to thereby change the axis of rotation of the drive wheel 15. While the vehicle 11 is on the auxiliary line 2, it may be loaded, unloaded, slowed down or stopped. If desired, certain vehicles may be provided with a tripping lever to selectively actuate the cylinder 8 whereby such vehicles would be transferred to the auxiliary line 2 while other vehicles not so constructed would continue along the main conveyor line 1. Once a vehicle is transferred onto the auxiliary conveyor line 2, a microswitch could be tripped to cause the device 3 to return to its original position as shown in solid lines in FIG. 7. Alternatively, such return of the device 3 could be accomplished by way of a time delay device which automatically returns the transfer device 3 to the solid line position after a predetermined time period.

The present invention may be embodied in other specific forms without departing from the spirit or essential attributes thereof and, accordingly, reference should be made to the appended claims, rather than to the foregoing specification as indicating the scope of the invention.

It is claimed:

1. Apparatus comprising:

a. a main conveyor line and an auxiliary conveyor line, a junction between said lines, b. each conveyor line having only one track and a horizontally disposed drive shaft, said shafts being rotatable about their longitudinal axes and being disposed below the elevation of said track, c. at least one vehicle for movement along said lines, said vehicle having a wheel for rolling contact with a horizontal surface of said tracks and a drive wheel for frictional contact with said shafts, means biasing said drive wheel so that its axis of rotation is angled with respect to the longitudinal axis of one of said shafts, d. a transfer means at said junction for transferring the vehicle between said lines in a manner so that said drive wheel is transferred from driving contact with one shaft to driving contact with the other shaft, and e. means associated with the auxiliary conveyor line adjacent the junction for changing the speed of the vehicle.

2. Apparatus in accordance with claim 1 wherein the drive shaft associated with the main conveyor line and the auxiliary conveyor line are at the same elevation, and said transfer device including a drive shaft at said same elevation.

3. Apparatus in accordance with claim 1 wherein said transfer means includes a pivotably mounted section of the track and drive shaft of said main conveyor line mounted to alternatively interconnect the auxiliary line and a portion of the main conveyor line.

4. Apparatus in accordance with claim 3 wherein said means for changing the speed of a vehicle includes an inclined surface below the elevation of said transfer means when the transfer means is positioned to transfer a vehicle between said lines.

5. Apparatus in accordance with claim 1 wherein a vertical plane containing the longitudinal axis of the drive shaft of the main conveyor line is between said one track and the center of gravity of the vehicle so that the weight of the vehicle maintains the drive wheel in contact with said drive shaft of the main conveyor line.

6. Apparatus in accordance with claim 1 wherein said track is comprised of a generally horizontal member interconnected with a generally vertical member.

7. Apparatus in accordance with claim 6 wherein said vehicle includes a first wheel for rolling contact with an upper horizontal surface of said vertical member and a second wheel for rolling contact with a vertical surface of said vertical member.

8. Apparatus in accordance with claim 7 wherein said first and second wheels are rotatable about a single vertical axis.

9. Apparatus in accordance with claim 1 wherein said transfer means is a single track and a horizontally disposed drive shaft supported for movement as a unit, said last-mentioned drive shaft being disposed below said last-mentioned track and being rotatable about its longitudinal axis.

10. Apparatus comprising a main conveyor line having two ends and an auxiliary conveyor line, a junction between said lines, each conveyor line having only a single track and a horizontally disposed drive shaft disposed below the elevation of said track, said shafts being rotatable about their longitudinal axes and being at substantially the same elevation, a transfer means at a junction between said conveyor lines for transferring vehicles between said lines in a manner so that a drive wheel on the vehicle is transferred from driving contact with one shaft to driving contact with the other shaft, said transfer means having only a single track and a horizontally disposed drive shaft supported for movement as a unit, the drive shaft of said transfer means being disposed below the elevation of the track of said transfer means and being rotatable about its longitudinal axis, one end of said transfer means being mounted for pivotable movement adjacent one end of said main conveyor line, the other end of said transfer means being movable between a position in alignment with an end of said auxiliary conveyor line and a position in alignment with an end of said main conveyor line, means for pivoting said other end of said transfer means between said positions.

11. Apparatus in accordance with claim 10 wherein the single track of each of said lines is disposed to one side of the longitudinal axis of the respective drive shaft of said lines and the single track of said transfer means is disposed to one side of the longtidinal axis of the drive shaft of said transfer means.

12. Apparatus in accordance with claim 6 including a means associated with the auxiliary conveyor line adjacent the junction for changing the speed of the vehicle.

13. Apparatus in accordance with claim 12 wherein said speed changing means includes an inclined surface adjacent an end of said auxiliary conveyor line.

14. Apparatus in accordance with claim 10 including a member for supporting both said transfer means drive shaft and track, said support member supporting said transfer means drive shaft below said transfer means track.

* * * * *